United States Patent [19]

Mikulin

[11] 4,170,824

[45] Oct. 16, 1979

[54] UNIVERSAL COMPASS

[76] Inventor: Tom T. Mikulin, 1469 Bellevue Ave., Burlingame, Calif. 94010

[21] Appl. No.: 845,894

[22] Filed: Oct. 27, 1977

Related U.S. Application Data

[63] Continuation of Ser. No. 726,949, Sep. 27, 1976, abandoned, which is a continuation-in-part of Ser. No. 672,297, Mar. 31, 1976, abandoned.

[51] Int. Cl.[2] ..... B43L 11/04

[52] U.S. Cl. ..... 33/30 C

[58] Field of Search ..... 33/27 K, 30 B, 30 C

[56] References Cited

U.S. PATENT DOCUMENTS

| | | | |
|---|---|---|---|
| 3,388 | 10/1887 | Bennett | 33/30 B |
| 1,055,303 | 3/1913 | Elliott | 33/30 C |
| 2,498,798 | 2/1950 | Edwards | 33/30 C |
| 2,632,953 | 3/1953 | Kafka | 33/30 C |
| 2,645,854 | 7/1953 | Dibrell | 33/30 C |
| 2,690,013 | 9/1954 | MacGuire | 33/30 C |
| 3,719,996 | 3/1973 | Filho | 33/30 C |

FOREIGN PATENT DOCUMENTS

| | | | |
|---|---|---|---|
| 25874 | 10/1906 | Austria | 33/30 B |
| 250172 | 8/1912 | Fed. Rep. of Germany | 33/30 C |
| 483720 | 9/1929 | Fed. Rep. of Germany | 33/27 K |
| 603712 | 9/1934 | Fed. Rep. of Germany | 33/30 C |

*Primary Examiner*—Charles E. Phillips

*Attorney, Agent, or Firm*—Flehr, Hohbach, Test, Albritton & Herbert

[57] ABSTRACT

A compass for drawing geometric figures including ellipses and polygons of different sizes and shapes. The compass includes an upstanding center post having a lower point which supports the compass on the drawing surface. A disc forming a peripheral cam track is detachably mounted on a holder which in turn is pivotally mounted on a medial portion of the post. The disc is connected with a plunger which is slidable in the post for selectively adjusting the angle of the disc. A head member is rotatably mounted on an upper portion of the post. An adjustable multiplier link carrying a marking element is pivotally mounted at its upper end to the head member at a point which is radially spaced from the post a distance greater than the maximum radius of the cam track. In one embodiment a cam follower is suspended from the head member by a parallelogram linkage, and spring means is provided to urge the roller into contact with the cam track. In another embodiment the cam follower comprises a ring which turns in positive engagement about the disc, with stabilizer fingers being mounted to turn about the post. An alternate stylus arm is mounted below the cam follower for use in drawing figures of short radii. In both embodiments disc can be detached from its holder for replacement with parts having a varied cam track for drawing a different geometric figure.

7 Claims, 6 Drawing Figures

UNIVERSAL COMPASS

CROSS-REFERENCE TO RELATED APPLICATION

This is a continuation of application Ser. No. 726,949 filed Sept. 27, 1976 which in turn is a continuation-in-part of application Ser. No. 672,297, filed Mar. 31, 1976 now abandoned.

BACKGROUND OF THE INVENTION

This invention relates in general to drafting instruments and in particular relates to compasses for drawing ellipses, polygons and similar geometric figures.

Ellipsographs have previously been provided for drawing variable ellipse figures. Examples are as disclosed in U.S. Pat. Nos. 3,719,996, 2,690,013, 2,498,798. However, the prior art instruments of this type have not been completely satisfactory for a number of reasons. The instruments are relatively unstable so that when pressure is applied as the figure is drawn the device tends to move out of adjustment. Furthermore, the prior art instruments cannot readily be adjusted because it is necessary to make repeated trial adjustments until the desired radii of the ellipse is attained. In the prior devices incorporating a multiplier arm, such as in U.S. Pat. No. 2,498,798, the angle of the multiplier arm changes as the angle of the cam is changed, with the unsatisfactory result that the ellipse being drawn is not symmetrical. Accordingly, the need has been recognized for a drafting instrument which will obviate the limitations and disadvantages of existing instruments.

OBJECTS AND SUMMARY OF THE INVENTION

It is a general object of the invention to provide a new and improved compass for drawing geometric figures such as ellipses and polygons.

Another object is to provide a compass of the type described which has a high degree of stability so that accurate figures can be drawn.

Another object is to provide a compass of the type described in which positive engagement is established between the cam follower and disc so that highly accurate figures can be rapidly drawn.

Another object is to provide a compass of the type described which can be rapidly adjusted in a single step to draw the desired figure.

Another object is to provide a compass of the type described which can be adjusted to obtain a selected multiplication ratio between the radii of the cam and the figure being drawn, and in which such multiplication is attained without affecting the symmetry of the figure being drawn.

The invention in summary comprises a compass which includes an upstanding center post having a lower end adapted to be supported on a graphics surface. An annular disc shaped to form a peripheral cam track is detachably and pivotally mounted by a holder to a medial portion of the post. A plunger is mounted for movement along the post and a link interconnects the plunger with the cam for adjusting the cam's angular position. A head member is rotatably mounted on the upper end of the post. A carrier is suspended from the head member through a parallelogram linkage. In one embodiment a cam follower is mounted on the carrier and is urged into contact with the outer periphery of the cam by means of a spring. In another embodiment a ring which is coupled with the carrier is mounted to turn in positive engagement about a groove formed in the disc. The head member carries a multiplier link for pivotal movement about an axis spaced at a radius greater than the maximum radius of the cam. The angular position of the multiplier link is adjusted by a slide which is mounted at one end for movement along a vertical guide formed along the carrier. Means is provided for locking the slide at a selected position along the multiplier link. A marking element is carried on a finger which in turn is adjustably mounted to the lower end of the multiplier link by an intermediate link. In one embodiment an alternate stylus arm is provided for drawing figures of relatively small size.

The foregoing and additional objects and features of the invention will appear from the following description in which the preferred embodiments have been set forth in detail in conjunction with the accompanying drawings.

DESCRIPTION OF THE PREFERRED EMBODIMENTS

Figure 1:
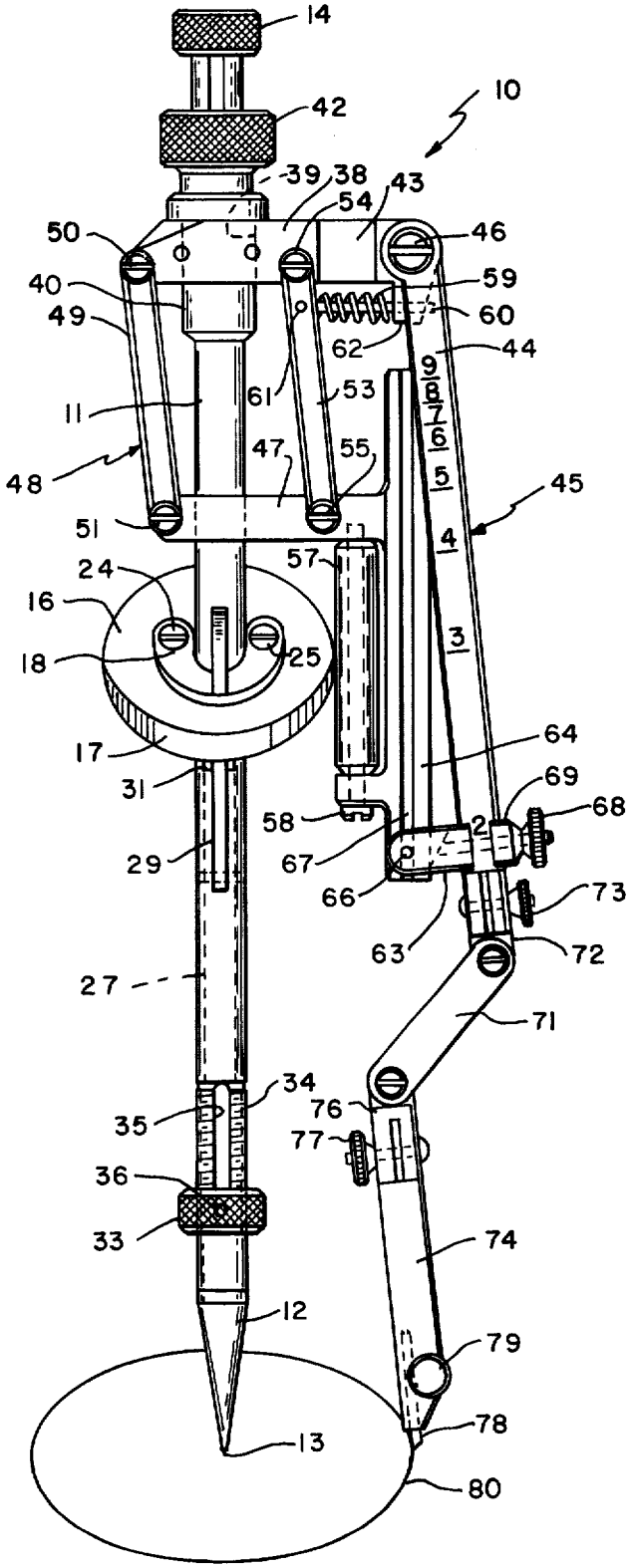
FIG. 1 is a side elevational view of one embodiment of the invention with the writing arm thereof turned to a position along the major axis of the ellipse being drawn.
Figure 3:
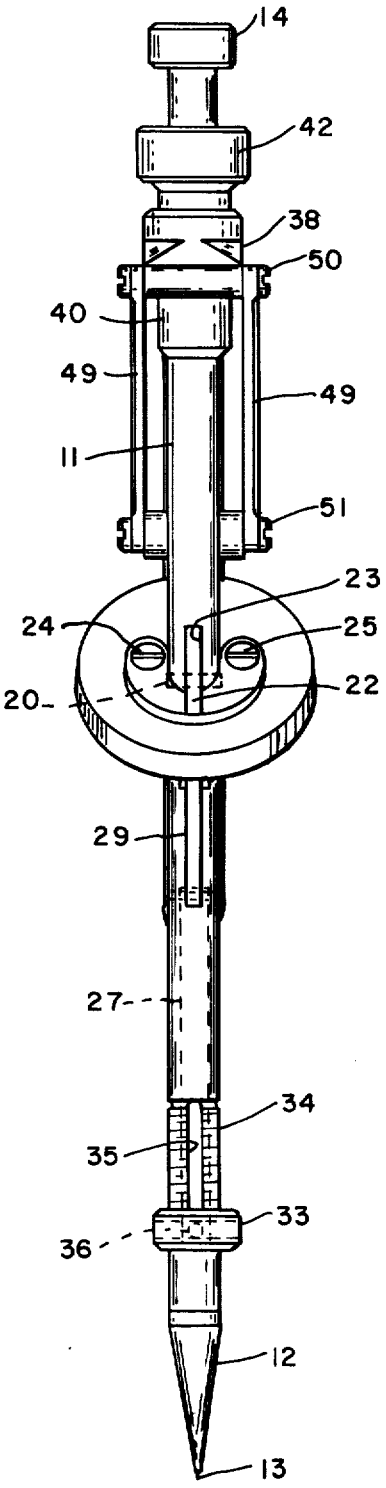
FIG. 3 is a side elevational view taken along the line 3—3 of FIG. 2.

In the drawings a compass instrument of one embodiment of the invention is illustrated generally at 10. Instrument 10 includes an elongate cylindrical center post 11 the lower end of which carries a solid cone 12 formed with a point 13 which is adapted to be placed on the graphics surface at the center of the geometric figure which is to be drawn. The upper end of the post is formed with a knurled enlargement 14 to facilitate holding the instrument.

Means forming a cam track about a medial portion of the post is provided and includes an annular disc 16 which is shown as formed with a circular outer periphery or cam track 17. The disc is detachably mounted on the post for pivotal movement about a horizontal axis by means of a C-shaped cam holder 18. A pair of pins 19, 20 are mounted on and project inwardly from the inner sides of the holder, and these pins seat in a slot, not shown, formed transversely through the post. A vertical rib 22 mounted on the holder slidably seats in a vertical slot 23 formed through a side of the post. The disc is secured to the underside of the holder by a pair of screw fasteners 24, 25.

Means is provided for adjustably positioning the angle of the disc so as to selectively vary the eccentricity of the ellipse being drawn. The adjusting means includes an elongate cylindrical plunger 27 slidably mounted within a longitudinal bore 28 formed through the lower end of the post. A connecting link 29 is pivotally mounted at its lower end to the upper end of the plunger and is also pivotally mounted at its upper end to tabs 31 which depend from cam disc 16. The link 29 projects through a vertical slot 32 formed in a side of the post. Plunger 27 is moved up and down within the bore of the post by means of a knurled adjusting ring 33 which engages external threads 34 formed along a lower portion of the post. A transverse pin 36 projecting from the lower end of the plunger seats within a circular groove 37 formed within the ring so that vertical movement of the ring carries the pin and thereby the plunger lengthwise of the post to pivot the cam disc. A vertical slot 35 in one side of the post accommodates sliding movement of pin 36. The threaded connection of the ring on the post is effective to securely hold the disc in the desired angle or attitude so that the figure can be precisely drawn on the surface without the instrument going out of adjustment.

A head member 38 formed with a vertical bore 39 is rotatably mounted above a shoulder 40 which is integral with the upper end of the post. A knurled knob 42 is carried above the head member. An arm 43 projects laterally from a side of the head member and an elongate multiplier link 44 of a writing arm assembly 45 is mounted at its upper end on the arm through a screw connection 46 for pivotal movement about a horizontal axis.

Cam follower means is provided and includes a carrier member 47 and a parallelogram linkage assembly 48. The carrier member 47 is mounted for radial movement below the head member by the parallelogram linkage assembly 48. The parallelogram assembly comprises a first pair of arms 49 pivotally interconnected between screw connections 50, 51 at the inner ends of the head and carrier members, together with a second pair of arms 53 pivotally interconnected between screw connections 54, 55 at the opposite sides of the head and carrier members. A roller 57 is mounted for rotation about a vertical axis on the carrier by means of an elongate screw connection 58. The roller is yieldably urged into contact with the cam track by means of a compression spring 59 carried on a shaft 60 which is connected between a cross pin 61 on the upper ends of the arms 53 and a boss 62 projecting downwardly from the outer end of the head member. As the head member is turned about the post the parallelogram assembly guides the carrier for radial movement without change of attitude as the roller follows the contour of the cam track.

Figure 2:
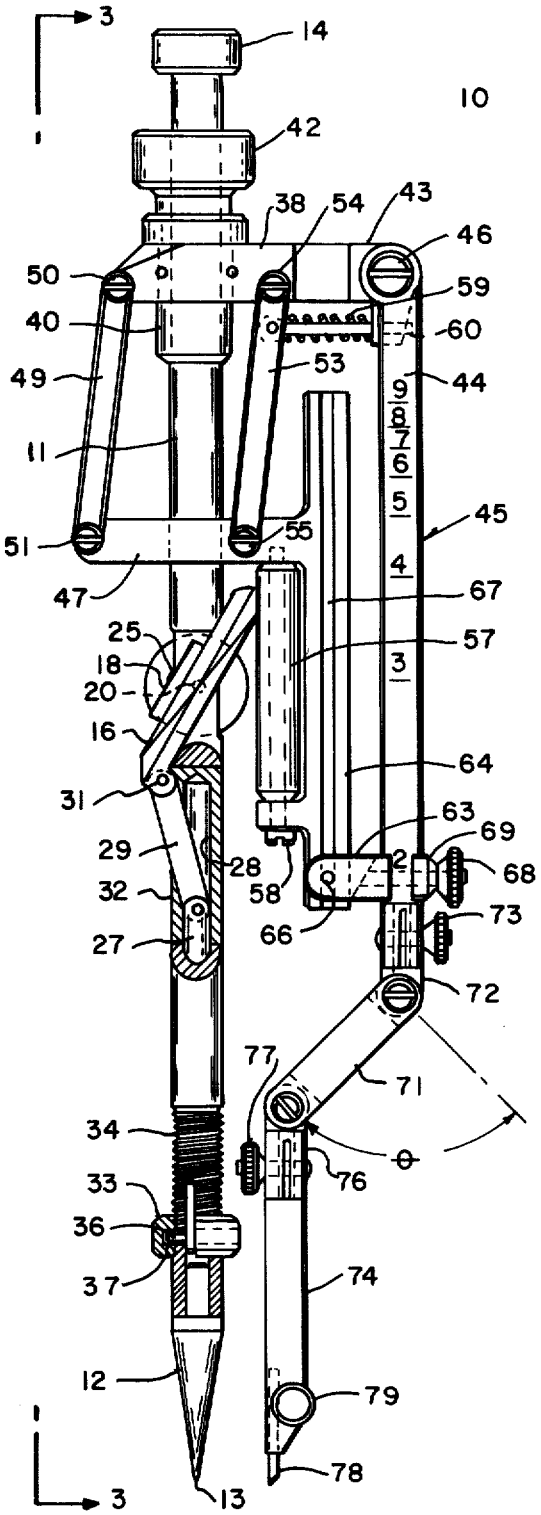
FIG. 2 is a side elevational view of the compass showing the writing arm turned to a position along the minor axis of the ellipse.

Writing arm assembly 45 includes the elongate multiplier link 44 which is pivotally mounted to head member 38 by connection 46 at a radius from post 11 which is greater than the maximum radius of the cam so that the ellipses which are drawn maintain their symmetry throughout adjustment of the cam position. The angle of the multiplier link relative to the head member is adjustably positioned by means of a slide 63 which is mounted at its inner end for sliding movement along a vertical guide 64 formed on carrier 47. An inwardly projecting pin 66 on the end of the slide moves within a vertical slot 67 formed along the guide. The outer end of the slide is channel-shaped so as to slide along the inner edge of the multiplier link. The slide is locked at any selected position along the link by means of a manually operated set screw 68 which is threadably mounted through a bracket 69 shaped to slide along the outer edge of the link. The inner end of the set screw is threadably engaged with the slide. A scale indicia is marked along one or both sides of the multiplier link to provide fiducial marks for positioning the multiplier link at the desired angle. As illustrated in FIG. 2 the fiducial marks range from "2" to "9". When the slide is locked at the various fiducial marks the angle of the multiplier link is thereby immediately adjusted to produce the corresponding multiplication ratio of the radius being drawn by the compass with respect to the cam track radius being contacted by the cam follower.

An intermediate link 71 is mounted at the lower end of the multiplier link by an articulated joint 72. A set screw 73 is carried in this joint for mounting and dismounting the intermediate link to the multiplier link. A stylus finger 74 is mounted to the lower end of the intermediate link by an articulated joint 76, and a set screw 77 is carried in this joint for mounting and dismounting of the finger. A suitable marking element such as an ink point or the illustrated pencil lead 78 is detachably mounted in the lower end of the finger by means of a set screw 79. The articulated joints 72, 76 frictionally hold the intermediate link and finger at the desired angular relationship, which can be adjusted as required through the angle $\theta$.

In the use and operation of the invention a cam disc of the desired configuration is selected. For example, the illustrated circular disc 16 is selected where the figure to be drawn is a circle or an ellipse. A disc having a polygon shaped periphery would be selected to draw a polygon. The disc is mounted to holder 18 by the screw fasteners 24, 25 and adjusted to the desired angle by turning ring 33 for moving plunger 27 along the post. Where the figure to be drawn is a circle the cam is pivoted to a plane normal to the longitudinal axis of the post, and for an ellipse the cam is pivoted to an inclined plane. The post is then placed upright on the graphics surface with the point 13 firmly held down by the user applying pressure on upper knob 14. The stylus finger 74 and intermediate link 71 are then adjusted to bring the marking element to the desired radius from the point, with the cam follower aligned with either the major or minor axes of the ellipse. For example, the compass is adjusted as shown in FIG. 2 with the marking element at a distance of ½ inch from the point where the foller is aligned with the upper edge of the cam disc. This ½ inch distance is the radius of the minor axis of the ellipse which is to be drawn. Slide 63 can then be moved along multiplier link 44 and locked in place adjacent the desired multiplier indicia. The figure is then drawn by turning head member 38 about the post with marking element 78 moving in and out drawing the ellipse 80 as the roller follows the cam track. Where it is desired to change the eccentricity of the ellipse the ring 33 is turned to move the plunger and change the angle of the cam disc. follower 103

Figure 4:
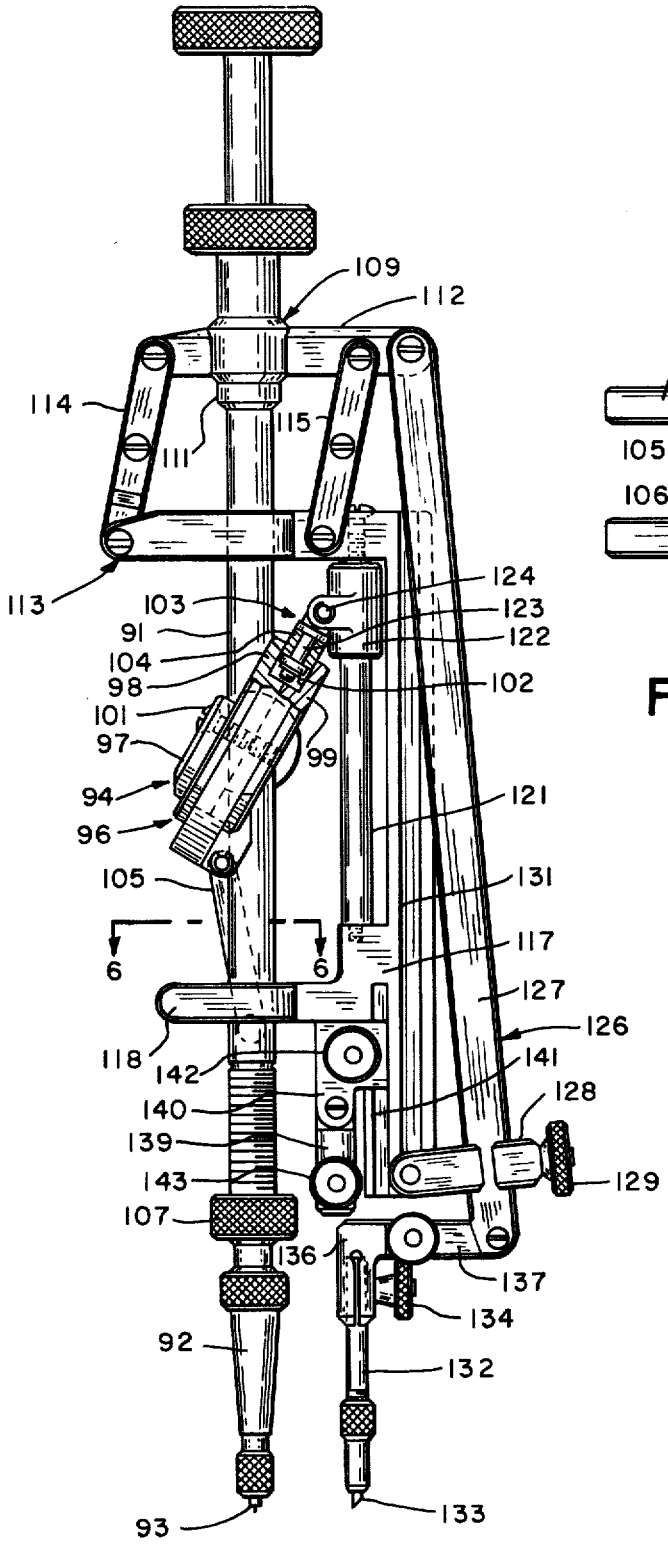
FIG. 4 is a side elevational view of another embodiment of the invention.
Figure 6:
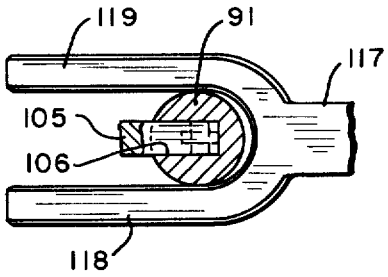
FIG. 6 is a cross section view taken along the line 6—6 of FIG. 4.
Figure 5:
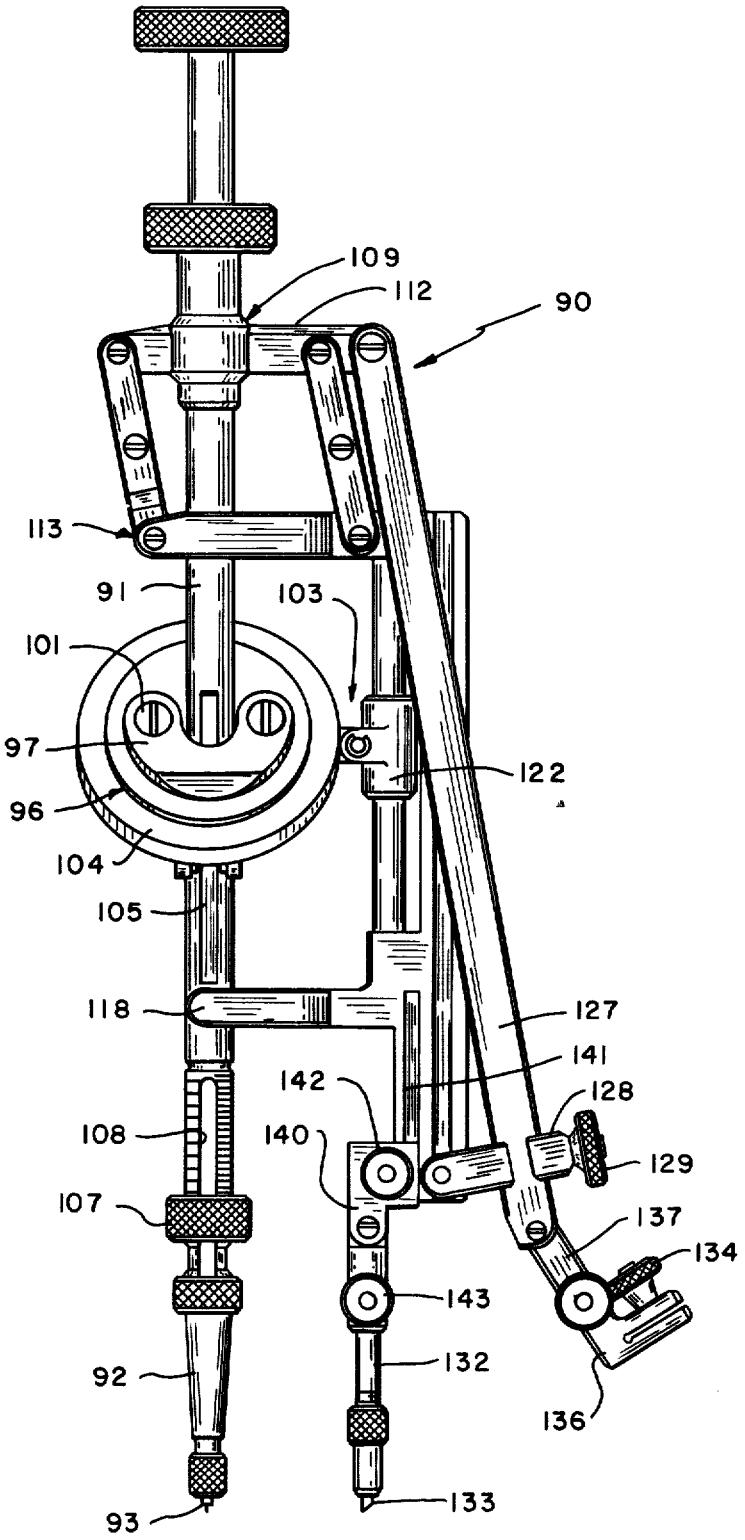
FIG. 5 is a side elevational view of the compass of FIG. 4 showing use of the alternate stylus arm.

FIGS. 4–6 illustrate another embodiment of the invention providing a compass instrument 90. Instrument 90 includes an upstanding post 91 formed at its lower end with a cone 92 and point 93 which support the instrument on the graphics surface. A cam 94 which includes a disc 96 is detachedly mounted on the post for movement about a horizontal axis by means of a C-shaped holder 97. The holder is constructed in a manner similar to that described for the embodiment of FIG. 1. Disc 97 is formed of a pair of circular segments 98, 99 secured together by the fasteners 101 which are threaded through holder 97. Peripheral shoulders are machined about the facing rims of the two disc segments so that when assembled a circular groove 102 is formed about the disc. Cam follower means is provided and includes a cam follower 103, a carrier member 113 and a parallelogram linkage assembly comprising arms 114 and 115. The cam follower103 includes an annulus 104 which is mounted within the groove for rotation about disc 96.

The angular position of disc 96 is adjusted to selectively vary the eccentricity of the ellipse being drawn by means which includes an elongate plunger, is not shown, which is slidably mounted within a bore formed in the lower end of the post in a manner similar to that described for the first embodiment. A link 105 extending through a slot 106 in the post is pivotedly mounted at its upper end to the disc and at its lower end to the plunger. An adjusting ring 107 is threaded on the post and a transverse pin, not shown, extends from the ring through a slot 108 in the post and into the plunger for moving the plunger and thereby the disc in the manner previously described.

A head member 109 is mounted for rotation about a shoulder 111 formed on the upper end of the post. The head member includes a transversely extending arm 112. The carrier member 113 is mounted for radial movement below the head member by the first and second pairs of arms 114, 115 connected in the manner described for the first embodiment. The carrier includes a guide portion 117 which extends downwardly parallel with the post, together with a pair of stabilizer fingers 118, 119 which project inwardly on opposite sides of the post. The fingers rotate about the post as the head member is turned and serve to stabilize the lower end of the carrier as it is rotated.

A vertically elongate guider rod 121 is mounted on the carrier parallel with the longitudinal axis of the post. A slide or collar 122 is mounted for movement on the rod and the collar carries a pivot joint 123 by means of a pin 124. The pivot joint comprises a pin which is mounted through a radially extending opening formed through a side of the annulus. The pivot joint restrains collar 122, and thereby the carrier, for movement with the annulus as the head member is turned about the post. The slide connection between the collar and rod accommodates axial displacement of the pivot joint as the ellipse is being drawn.

A writing arm assembly 126 is provided and includes a multiplier link 127 which is pivotally mounted at its upper end to the distal end of arm 112. A slide 128 is mounted for movement along multiplier link and is selectively locked in position by means of set screw 129. The inner end of the slide moves along channels 131 formed in opposite sides of carrier guide 117. Suitable indicia, such as numbered fiducial marks, not shown, can be provided along the length of the multiplier link to set up the desired multiplication ratio between the radius of the figure drawn by the compass and the radius of the location of the pivot joint on the cam. A stylus finger 132 carrying a marking element 133 is detachably mounted by set screw 134 on a stylus arm 136. The stylus arm is mounted on an intermediate link 137 which in turn is pivotally mounted on the lower end of multiplier link 127.

An alternate stylus arm 139 is pivotally mounted on a slide 140 which in turn is mounted for sliding movement along grooves 141 formed on opposite sides of the inner side of guide portion 117. A set screw 142 is provided to selectively lock the slide between the upper or retracted position of FIG. 4 in the lower writing position of FIG. 5. A set screw 143 is provided on the stylus arm for detachably mounting stylus finger 132 and marking element 133 when the latter are detached from the stylus arm carried by multiplier link 127.

In the operation of compass 90 the instrument is initially set up with stylus finger 132 attached to arm 136 on the multiplier link. The post is placed upright on the graphics surface at the center of the figure to be drawn. Adjusting ring 107 is turned to pivot cam disc 96 and thereby swing carrier 113 so as to move the marking element to the desired radius along either the major or minor axis of the ellipse. Slide 128 is then moved along the multiplier link and locked in place adjacent the indicia which produces the desired multiplication ratio. With the user applying downward pressure on the post head member 109 is rotated to move the marking element along an elipse path which is generated by the carrier as it moves with annulus 104 while the latter rotates about the disc groove 102. The eccentricity of the ellipse is varied by turning adjusting ring 107 to change the angle of the cam disc.

Where it is desired to draw figures of relatively short radius then stylus finger 132 is detached from arm 136 and placed into and locked on alternate stylus arm 139. The arm 136 is pivoted clear of the inner arm as shown in FIG. 5. With the post placed on the graphics surface head member is rotated to draw the ellipse with the alternate stylus arm in a manner similar to that previously described.

While the foregoing embodiments are at present considered to be preferred it is understood that numerous variations and modifications may be made therein by those skilled in the art and it is intended to cover in the appended claims all such variations and modifications as fall within the true spirit and scope of the invention. What is claimed is:

1. A compass for drawing geometric figures on a surface, including the combination of an upstanding center post having a lower end for supporting the compass on the surface, a head member mounted for rotation about the longitudinal axis of the post, a writing arm mounted at its upper end on the head member for pivotal movement about a horizontal axis, said writing arm carrying a marking element, a cam mounted about a medial portion of the post, cam follower means including linkage means mounted on the head member for rotary movement about the cam and for radial movement with respect to the post, said radial movement being independent of said pivotal axis of the writing arm, said horizontal axis of the writing arm being spaced from the post axis a radius greater that the maximum radius of the cam, means cooperating between said writing arm and a distal portion of said follower means for adjustably positioning said writing arm with respect to said follower means about said horizontal axis whereby a predetermined multiplication ratio is established between the radius marked on the surface by the end of the writing arm and the radius of the cam at which the cam follower means is in register.

2. A compass as in claim 1 in which the cam follower means includes a carrier and a roller mounted on the carrier for rotation about a vertical axis, and the linkage means comprises parallelogram arm means interconnected between the carrier and head member whereby the carrier and thereby the roller undergo radial movement to and from the post without change of attitude.

3. A compass as in claim 1 in which the cam comprises a circular disc, and the cam follower means comprises an annulus mounted for rotation about the disc together with means for interconnecting the head member and thereby the writing arm for movement with the annulus.

4. A compass as in claim 3 in which the means for interconnecting the writing arm for movement with the annulus comprises a carrier mounted on the head member for radial movement with respect to the post, an elongate guide rod mounted on the carrier and extending parallel with the post, pivot joint means mounted for movement along the guide rod and pivotally connected with the annulus, the carrier including a pair of stabilizer fingers projecting inwardly in close spaced relationship along opposite sides of the post for stabilizing the lower end of the carrier as it is rotated with the head member about the post.

5. A compass as in claim 1 in which the cam includes a disc forming a peripheral cam track having a given configuration, said disc being mounted on the post for pivotal movement about a horizontal axis whereby the figure which is drawn on the surface by the writing arm can be selectably varied from circular to ellipsoidal as the disc is varied in position between horizontal and inclined orientations, a plunger mounted for movement along the post, means for interconnecting the plunger with the disc for moving the pivotal orientation of the disc responsive to movement of the plunger along the post and means for locking the plunger at a selected position along the post.

6. A compass as in claim 5 which includes means for detachably mounting the disc on the post whereby a disc having a varied cam track configuration can be mounted on the post for drawing varied geometric figures on the surface, said detachable means comprising a holder, means for mounting the holder for pivotal movement about a horizontal axis on the post, and fastener means for detachably mounting the cam to the holder.

7. A compass for drawing geometric figures on a surface, including the combination of an upstanding center post having a lower end for supporting the compass on the surface, a head member mounted for rotation about the longitudinal axis of the post, a writing arm mounted at its upper end on the head member for pivotal movement about a horizontal axis, said writing arm carrying a marking element, a cam disc mounted on the post, means for orienting the disc at a selected attitude with respect to the post, a circular cam follower concentric with the disc and mounted for rotation about the axis of the disc, a carrier mounted for rotation with the head member and for radial movement relative to the post, means for connecting a medial portion of the writing arm with the carrier, means for connecting the carrier for movement with the cam follower whereby rotation of the cam follower about the disc causes the carrier to move the writing arm in a predetermined path about the post.

* * * * *